US006007410A

United States Patent [19]

Nerenberg

[11] Patent Number: 6,007,410

[45] Date of Patent: Dec. 28, 1999

[54] PIPEFACING TOOL

[76] Inventor: Bruno Nerenberg, 310 Scarth Street, N. Regina, Saskatchewan, Canada, S4R 2Z7

[21] Appl. No.: 09/130,372

[22] Filed: Aug. 7, 1998

[51] Int. Cl.[6] ..... B24B 7/16

[52] U.S. Cl. ..... 451/51; 451/61; 451/439; 451/441; 29/282

[58] Field of Search ..... 451/51, 439, 440, 451/441, 431, 61; 144/205; 29/33 T, 282

[56] References Cited

U.S. PATENT DOCUMENTS

| | | | |
|---|---|---|---|
| 1,031,934 | 7/1912 | Hunter | 451/441 |
| 2,188,720 | 1/1940 | McQuade | 451/441 |
| 2,414,731 | 1/1947 | Forbes, Jr. | 451/439 |
| 2,846,828 | 8/1958 | Pilon, Sr. | 451/441 |
| 3,908,491 | 9/1975 | Gilmore . | |
| 4,327,526 | 5/1982 | Pettyjohn et al. | 451/440 |
| 4,625,601 | 12/1986 | Brummet . | |
| 4,934,109 | 6/1990 | Allred | 451/439 |

*Primary Examiner*—Robert A. Rose
*Attorney, Agent, or Firm*—Adrian D. Battison; Murray E. Thrift

[57] ABSTRACT

The present invention relates to a method for squaring pipe ends. The method can be used for squaring the ends of a single pipe length or the facing ends of two cut pipe portions of an existing pipe. The method is particularly useful in inserting a new pipe length into an existing pipe line where the line is cut to form two ends to which the pipe length is to be welded.

11 Claims, 4 Drawing Sheets

PIPEFACING TOOL

BACKGROUND OF THE INVENTION

Previous arrangement have been propose for grinding pipe ends. For example, in the U.S. Pat. No. 4,625,601, of Brummet is disclosed a hand held pipe lathe. However this has little or no practical use in the field of the present invention. Brummet is intended for cutting a pipe not for squaring. The single scissor type mounting arrangement with the motor driven cutting device does not take into effect that there are flats spots on pipes so the tool actually squaring the pipe is minimal.

Also in the U.S. Pat. No. 3,908,491, of Gilmore, there is a single sided spider mounting arrangement. However this creates a chance of slippage resulting in an unsquared edge. Gilmore also discloses an external tool for cutting grooves, which may resurface if it does not slip.

SUMMARY OF THE INVENTION

It is one object therefore to provide an improved method for squaring ends of a pipe.

According to one aspect of the invention there is provided a method for squaring the ends of a pipe comprising;

providing a pipe having a peripheral wall with an inner surface surrounding an axis and having two open ends each defining an outer edge for squaring;

inserting into the pipe an elongate, straight, central mounting beam so as to extend along the pipe and extend outwardly from the ends;

providing a first and a second support spider each arranged adjacent a respective end of the beam and a respective end of the pipe and each having a center hub at the beam and a plurality of legs extending radially outwardly from the hub to the inner surface for supporting the beam at the axis of the pipe, the legs being angularly spaced around the axis, the legs each having an adjustment portion for adjusting a length of the leg from the hub to the inner surface;

adjusting the legs while measuring the position of the beam relative to the inner surface to locate the beam at the axis;

and while maintaining the beam in a fixed position on the axis of the pipe;

mounting on the beam a rotating hub at a first open end of the pipe to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said first end in said grinding plane;

mounting on the beam a rotating hub at the second open end of the pipe to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said second end in said grinding plane;

such that the first and second ends lie in planes accurately radial to the axis of the pipe.

Preferably the method includes providing an inclined support brace on the rotating hub connecting to the arm and actuating a turn buckle on the support arm to adjust the arm to the right angle.

Preferably the method includes providing the rotating hub is fixed in position so that the grinding tool engages the outer edge consistently;

Preferably the method includes providing a second grinding tool for squaring the first and second ends simultaneously.

Preferably the grinding tool comprises a disk mounted in the grinding plane for rotation about an axis at right angles to the grinding plane.

According to a second aspect of the invention there is provided a method for squaring adjacent ends of two aligned pipes comprising;

providing two aligned pipes each having a peripheral wall with an inner surface surrounding an axis and respective adjacent open ends each defining an outer edge for squaring, the open ends facing each other with a space therebetween and the pipes having the axes thereof at least substantially aligned;

inserting into the pipes an elongate, straight, central mounting beam so as to extend partly into each pipe and to bridge the space;

providing a first and a second support spider each arranged adjacent a respective end of the beam and within a respective end of the pipes and each having a center hub at the beam and a plurality of legs extending radially outwardly from the hub to the inner surface for supporting the beam at the axis of the pipe, the legs being angularly spaced around the axis, the legs each having an adjustment portion for adjusting a length of the leg from the hub to the inner surface;

adjusting the legs at each pipe end while measuring the position of the beam relative to the inner surface of the respective pipe to locate the hub and the adjacent portion of the beam at the axis of the respective pipe;

and while maintaining the beam in a fixed position on the axes of the pipes;

mounting on the beam a rotating hub at the open end of the first pipe to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said end of the first pipe in said grinding plane;

mounting on the beam a rotating hub at the open end of the second pipe to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said end of the second pipe in said grinding plane;

such that the ends of the first and second pipes lie in planes accurately radial to the axis.

According to a third aspect of the invention there is provided a method for connecting a pipe length into an existing pipe comprising:

cutting the existing pipe to form two spaced ends of two pipe portions separated by a space and facing each other for receiving the pipe length therebetween;

providing the pipe length having a peripheral wall with an inner surface surrounding an axis and having two open ends each defining an outer edge for squaring;

inserting into the pipe length an elongate, straight, central mounting beam so as to extend along the pipe length and extend outwardly from the ends;

providing a first and a second support spider each arranged adjacent a respective end of the beam and a respective end of the pipe length and each having a center hub at the beam and a plurality of legs extending radially outwardly from the hub to the inner surface for supporting the beam at the axis of the pipe length, the legs being angularly spaced around the axis, the legs each having an adjustment portion for adjusting a length of the leg from the hub to the inner surface;

adjusting the legs while measuring the position of the beam relative to the inner surface to locate the beam at the axis;

and while maintaining the beam in a fixed position on the axis of the pipe length;

mounting on the beam a rotating hub at a first open end of the pipe length to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said first end in said grinding plane;

mounting on the beam a rotating hub at the second open end of the pipe length to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said second end in said grinding plane;

such that the first and second ends lie in planes accurately radial to the axis of the pipe length;

the two pipe portions being aligned and each having a peripheral wall with an inner surface surrounding an axis and respective adjacent open ends each defining an outer edge for squaring, the open ends facing each other with said space therebetween and the pipe portions having the axes thereof at least substantially aligned;

inserting into the pipe portions an elongate, straight, central mounting beam so as to extend partly into each pipe portion and to bridge the space;

providing a first and a second support spider each arranged adjacent a respective end of the beam and within a respective end of the pipe portions and each having a center hub at the beam and a plurality of legs extending radially outwardly from the hub to the inner surface for supporting the beam at the axis of the pipe portion, the legs being angularly spaced around the axis, the legs each having an adjustment portion for adjusting a length of the leg from the hub to the inner surface;

adjusting the legs at each end while measuring the position of the beam relative to the inner surface of the respective pipe portion to locate the hub and the adjacent portion of the beam at the axis of the respective pipe portion;

and while maintaining the beam in a fixed position on the axes of the pipe portions;

mounting on the beam a rotating hub at the open end of the first pipe portion to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said end of the first pipe portion in said grinding plane;

mounting on the beam a rotating hub at the open end of the second pipe to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said end of the second pipe portion in said grinding plane;

such that the ends of the first and second pipe portions lie in planes accurately radial to the axis;

inserting the pipe length into the space between the pipe portions;

and welding the ends of the pipe length to the ends of the pipe portions.

In general therefore, a pair of mounting members defining centring spiders consisting of adjustable arms hold an elongate member which then is extended along the axis of the pipe or pipes. A grinding tool is mounted on the elongate member so that the grinding tool is at right angles to the elongate member for squaring the ends of the pipe or pipes. The present invention allows a person or persons to square the respective ends of pipe or pipes without removing or adjusting the tool.

The present invention is ideal for field use at such sites for oil lines and the like, resulting in less time and energy for the worker in turn costing less money to do the job at the site.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
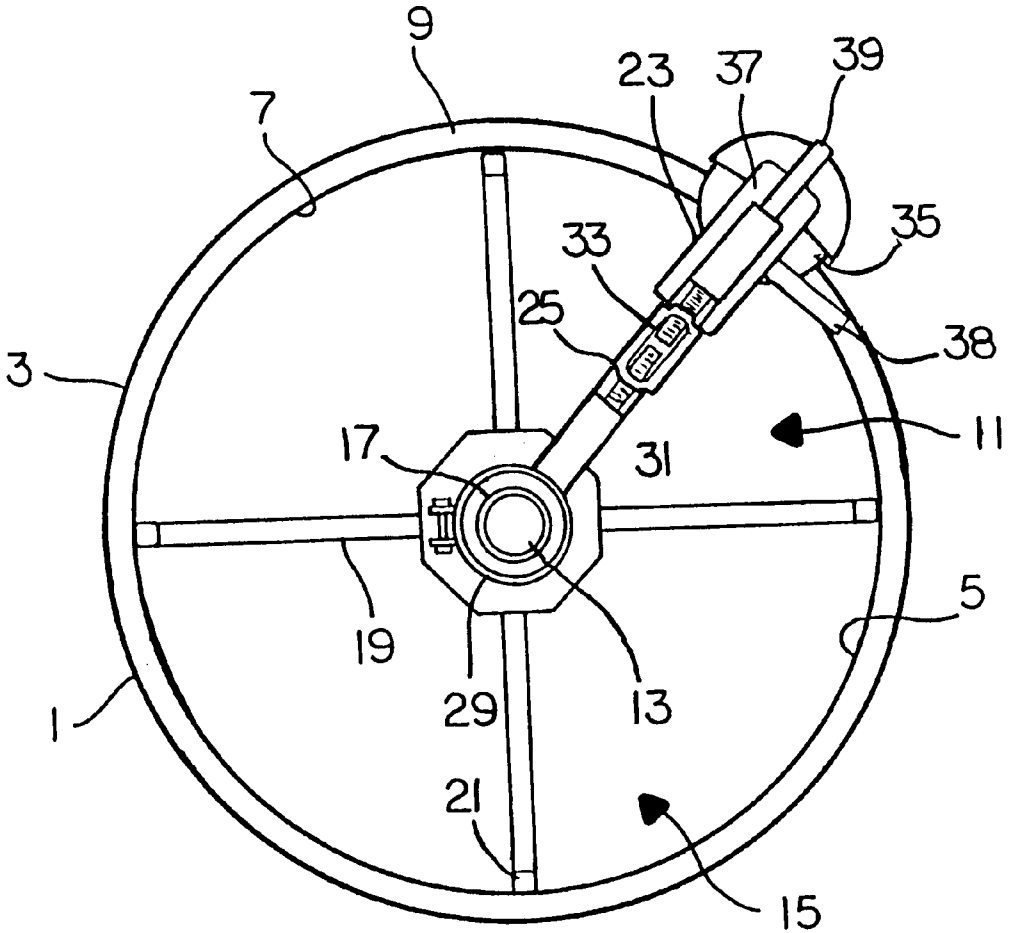
FIG. 1 is a front elevational view of the present invention.

A pipe 1 has an outer surface 3, an inner surface 5, an open end 7 and an outer edge 9. The outer edge 9 is located along the edge of the open end 7.

Mounted in the pipe 1 is a squaring device 11. The squaring device 11 has an elongate beam 13 defining a tube that extends along the pipe 1 on the axis. The elongate beam 13 is supported at respective ends by a spider mount arrangement, generally indicated at 15, and a second spider mount arrangement, generally indicated at 16.

The spider mount arrangement 15 has a central hub defining an opening 17 in which the elongate beam 13 is located. The spider mount arrangement is perpendicular to the elongate member and thus lies in a radial plane. A plurality of mount legs 19 extends outwardly from the spider mount arrangement 15. The spider mount legs 19 engage the inner surface at angularly spaced positions. The spider mount legs have adjustable portions 21 located on the outermost ends which can be adjusted inward or outward. The mount arrangement is adjusted using micrometer measurement of the position of the beam relative to the axis so that the elongate beam when adjusted 13 lies accurately on the axis of the pipe.

A grinder 23, which can be electrically driven or air driven, at the outer edge 9 of the pipe has an arm 25 which is mounted on a first rotor 27. The first rotor 27 is fixed to the elongate member 13 and rotates about the axis of the pipe. The arm 25 extends outwardly at right angle from the first rotor 27 to the grinder 23. The grinder 23 is arranged to square the outer edge 9 of the pipe. A second rotor 29 is located on the elongate member behind the first rotor 27. The second rotor has an adjustment arm 31 which extends outwardly to the arm 25 and has a hinge 26 at the grinder 23. The adjustment arm 31 has a turn buckle 33 which can be turned for ensuring the grinder 23 is at a right angle.

The grinder 23 has a disk 35 lying in a radial grinding plane on a motor arrangement 37 for engaging the outer edge 9. A handle 38 on the grinder 23 extends outwardly on a respective side for operator use. A safety bar 39 extends upward and bends forwardly above the grinder disk 35 for operators use.

Figure 2:
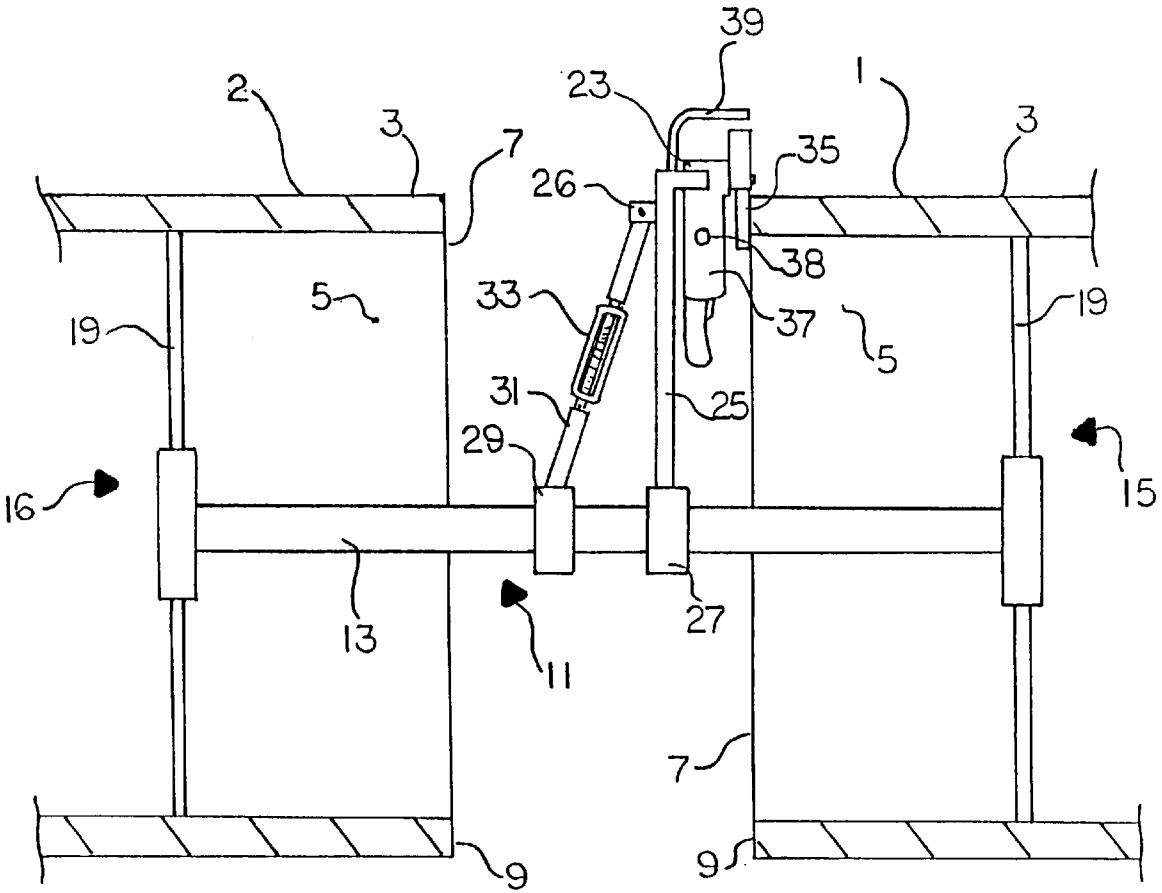
FIG. 2 is a side elevational view of a second embodiment of the present invention.
Figure 3:
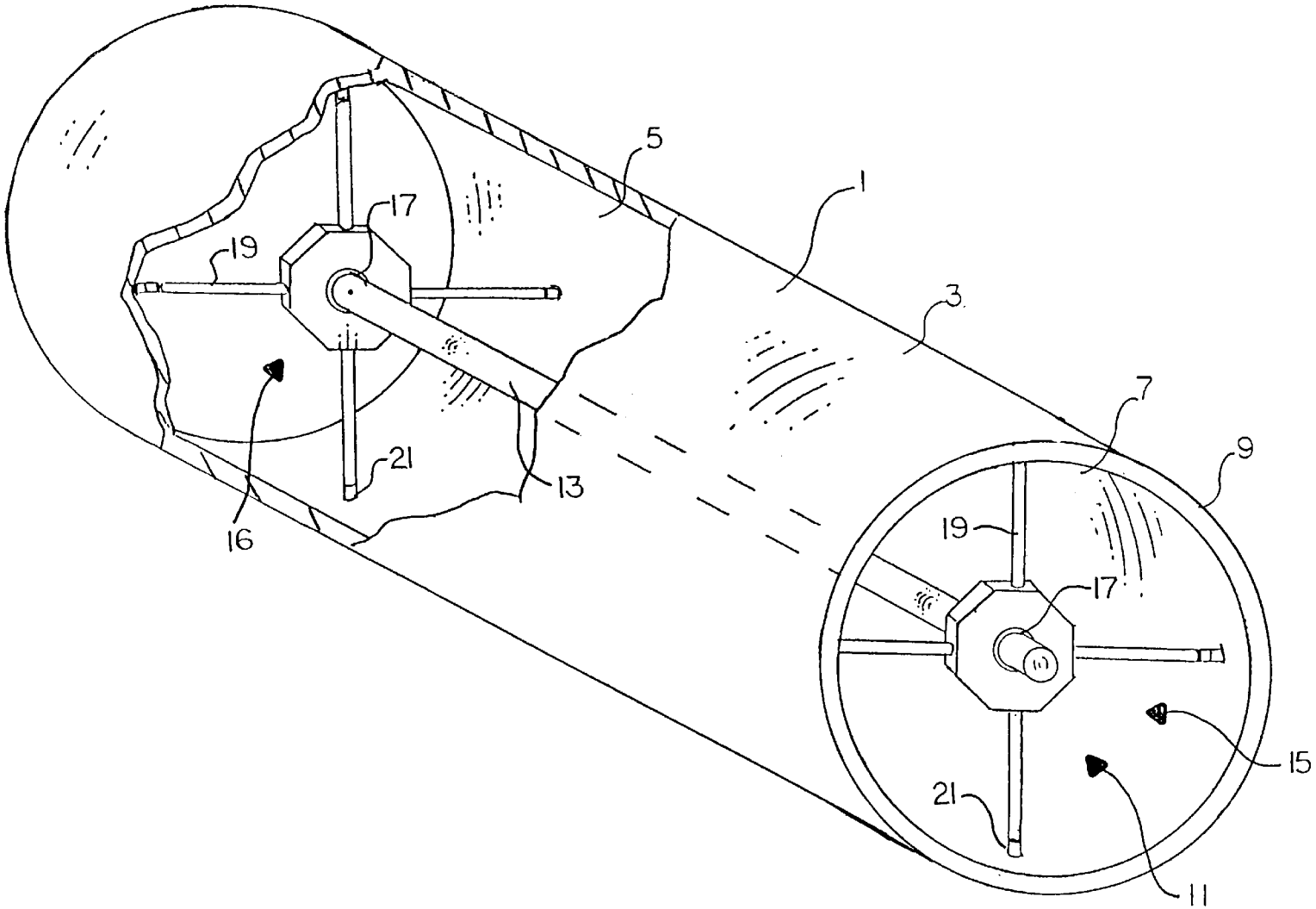
FIG. 3 is an isometric view of the present invention.

As best shown in FIG. 2, a second arrangement in which the squaring device squares the open edges of a pipe 1 and a second pipe 2 in which the open ends 7 are facing towards either end. The second arrangement consists of the mounting arrangements being located in respective pipes so that the respective outer edge of the pipes can be squared.

Figure 4:
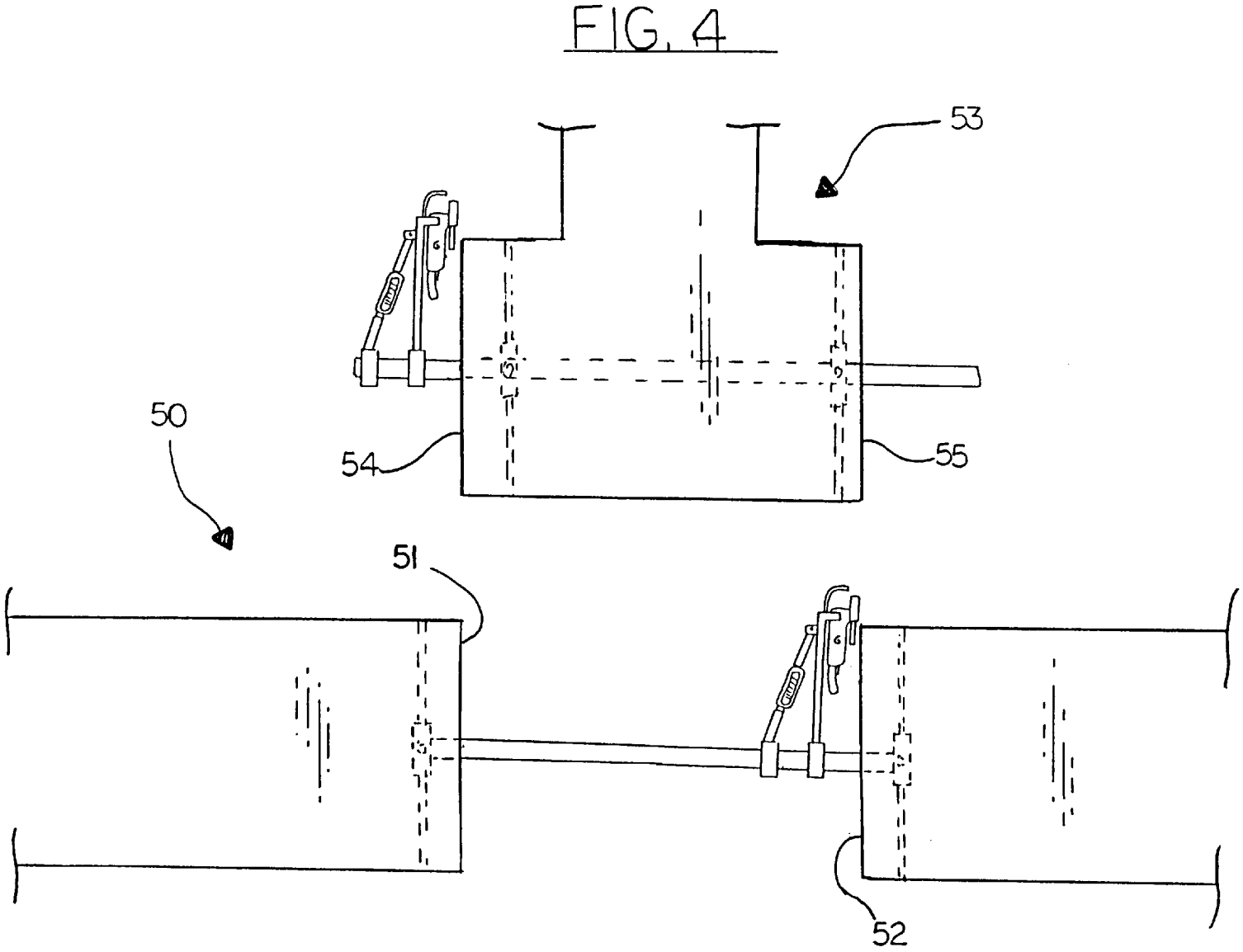
FIG. 4 is a schematic plan view of a method of use of the above apparatus for inserting a pipe length into an existing pipe line.

Turning now to FIG. 4 there is shown an existing pipe line 50 in which it is required to insert an additional pipe length 53 which in the example shown is a T-piece allowing the pipe line to be capped. The existing pipe line 50 is cut at two spaced cut lines to define ends 51 and 52 which are facing and generally aligned and substantially coaxial. However the ends can be misaligned through inaccurate cutting and can be slightly distorted from the coaxial arrangement due to forces in the pipe line prior to cutting. Between the ends 51 and 52 is defined a space which is equal in length to the length of the pipe length to be inserted. The pipe length has ends 54 and 55.

The ends 54 and 55 are squared using the technique described above in which the beam is located within the pipe length for lying directly on the axis of the pipe length. The ends 51 and 52 are squared using the technique shown above in which the beam is located by spiders within the pipe portions of the existing pipe line. When accurately squared, the pipe length can be accurately inserted into the space between the pipe portions and it is sure therefore that the ends will properly abut and will lie accurately in radial planes of the pipe 50 and the coaxially inserted pipe length 53. Thus the point of the invention is to square-up and true-up the ends of two pipes at one time. Thus two ends of cut pipe facing each other as described above can be squared or two ends on opposite ends of the same pipe length facing each other can also be squared.

The above tool uses two centering spiders on each end of the main beam. These hold the main beam in front of the two inch pipe on which the rotor mounts and holds the electric grinder. The ends are centred with a micrometer until the centring spider is exactly 100% true to the axis of the pipe. The same is done on the other end until it is 100% true and both end spiders are locked so that they will not move. Now the spiders are locked to the pipe or beam and the rotor is also locked to the beam. Now the ends of the pipe may be tooled, first at one end and then at the other end. Both ends may be tooled simultaneously by placing two rotors on the same beam. This is all done without moving any of the spiders or the locked-in shaft or rotor until both ends are faced-up completely. The tool can now be removed. Both ends of the pipe are now 100% square and true with each other even if the two pipes have different centre lines or different elevations. In the past thirty years or more, this squaring of the ends has been a significant problem and has necessitated the use of string, straight edges, levels and squares but still provided difficulties. Using the present invention, the time necessary to effect this squaring action can be reduced to approximately one quarter of that previously required.

The present invention is not intended to provide a tool which will restore or bevel the pipe. The bevel after the end is ground square may be restored by hand using a hand grinder. However to put the face or land on the pipe is the most important thing in fitting together the joint of the pipe for welding. When dealing with four pipe ends as shown in FIG. 4 with the large bore pipe, this is very critical. This is very important on final tie-in welds such as that shown above where a pipe length is inserted as well this can not go inside the pipe to do a repair should the weld turn out to be faulty.

The sole purpose of the invention is to square and true up the ends of two pipes art one time. This it does if we have two ends of cut pipe facing each other or if the two ends are on opposite ends of the same pipe, facing away from each other. The tool uses two centering spiders on each end of the pipe. These hold the two-inch pipe on which the rotor mounts and holds the electric grinder. The ends are centered with a micrometer until the centering spider is 100% true to the axis of the center line of the pipe. The same is done on the other end until it is 100% true and both ends are locked so they will not move. Now the spiders are locked to the pipe and the rotor is also locked to the pipe. Now the ends of the pipe may be tooled, first one end and then the other.

Both ends may be tooled at the same time by placing two rotors on the same shaft. This is all done without moving any of the spiders or the locked shaft or rotor until both ends are faced up completely. The tool can now be removed. Both ends of the pipe are now 100% square and true with each other even if the two pipes have different center lines or are at different elevations. In the past thirty or more years this has been a problem as it was checked with a string, straight edges, levels and squares and we still had trouble getting a good fit up. The time to do this work could take anywhere from four to six times longer with more people required to do the work.

The main purpose of the tool is to align and square of the two ends of pipe which are facing each other, or square off the two opposing ends of pipe. This is done in the same operation and can not be done with any of the other patents listed.

The tool will not put on or restore the bevel to the pipe. The bevel may be restored by hand, using a hand grinder. This was never the intent of the tool. To put the face or the land on the pipe is the most important thing in fitting up a joint of pipe for welding. When dealing with four pipe ends on large bore pipe, this is very critical. This is very important on final tie-in welds as the welders can't go inside the pipe to do a repair on a bad weld.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

I claim:

1. A method for squaring the ends of a pipe comprising;

providing a pipe having a peripheral wall with an inner surface surrounding an axis and having two open ends each defining an outer edge for squaring;

inserting into the pipe an elongate, straight, central mounting beam so as to extend along the pipe and extend outwardly from the ends;

providing a first and a second support spider each arranged adjacent a respective end of the beam and a respective end of the pipe and each having a center hub at the beam and a plurality of legs extending radially outwardly from the hub to the inner surface for supporting the beam at the axis of the pipe, the legs being angularly spaced around the axis, the legs each having an adjustment portion for adjusting a length of the leg from the hub to the inner surface;

adjusting the legs while measuring the position of the beam relative to the inner surface to locate the beam at the axis;

and while maintaining the beam in a fixed position on the axis of the pipe;

mounting on the beam a rotating hub at a first open end of the pipe to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said first end in said grinding plane;

mounting on the beam a rotating hub at the second open end of the pipe to rotate about the axis;

mounting on the rotating hub an arm extending outwardly at a right angle to the beam;

mounting a grinding tool on the arm at a riglht angle to the arm so as to define a grinding plane accurately at right angles to the axis;

and rotating the arm around the axis to effect grinding of said second end in said grinding plane;

such that the first and second ends lie in planes accurately radial to the axis of the pipe.

2. The method according to claim 1 including providing an inclined support brace on the rotating hub connecting to the arm and actuating a turn buckle on the support arm to adjust the arm to the right angle.

3. The method according to claim 1 including providing the rotating hub is fixed in position so that the grinding tool engages the outer edge consistently.

4. The method according to claim 1 including providing a second grinding tool for squaring the first and second ends simultaneously.

5. The method according to claim 1 wherein the grinding tool comprises a disk mounted in the grinding plane for rotation about an axis at right angles to the grinding plane.

6. A method for squaring adjacent ends of two aligned pipes comprising;

providing two aligned pipes each having a peripheral wall with an inner surface surrounding an axis and respective adjacent open ends each defining an outer edge for squaring, the open ends facing each other with a space therebetween and the pipes having the axes thereof at least substantially aligned;

inserting into the pipes an elongate, straight, central mounting beam so as to extend partly into each pipe and to bridge the space;

providing a first and a second support spider each arranged adjacent a respective end of the beam and within a respective end of the pipes and each having a center hub at the beam and a plurality of legs extending radially outwardly from the hub to the inner surface for supporting the beam at the axis of the pipe, the legs being angularly spaced around the axis, the legs each having an adjustment portion for adjusting a length of the leg from the hub to the inner surface;

adjusting the legs at each pipe end while measuring the position of the beam relative to the inner surface of the respective pipe to locate the hub and the adjacent portion of the beam at the axis of the respective pipe;

and while maintaining the beam in a fixed position on the axes of the pipes;

mounting on the beam a rotating hub at the open end of the first pipe to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said end of the first pipe in said grinding plane;

mounting on the beam a rotating hub at the open end of the second pipe to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said end of the second pipe in said grinding plane;

such that the ends of the first and second pipes lie in planes accurately radial to the axis.

7. The method according to claim 6 including providing an inclined support brace on the rotating hub connecting to the arm and actuating a turn buckle on the support arm to adjust the arm to the right angle.

8. The method according to claim 6 including providing the rotating hub is fixed in position so that the grinding tool engages the outer edge consistently.

9. The method according to claim 6 including providing a second grinding tool for squaring the first and second ends simultaneously.

10. The method according to claim 6 wherein the grinding tool comprises a disk mounted in the grinding plane for rotation about an axis at right angles to the grinding plane.

11. A method for connecting a pipe length into an existing pipe comprising:

cutting the existing pipe to form two spaced ends of two pipe portions separated by a space and facing each other for receiving the pipe length therebetween;

providing the pipe length having a peripheral wall with an inner surface surrounding an axis and having two open ends each defining an outer edge for squaring;

inserting into the pipe length an elongate, straight, central mounting beam so as to extend along the pipe length and extend outwardly from the ends;

providing a first and a second support spider each arranged adjacent a respective end of the beam and a respective end of the pipe length and each having a center hub at the beam and a plurality of legs extending radially outwardly from the hub to the inner surface for supporting the beam at the axis of the pipe length, the legs being angularly spaced around the axis, the legs each having an adjustment portion for adjusting a length of the leg from the hub to the inner surface;

adjusting the legs while measuring the position of the beam relative to the inner surface to locate the beam at the axis;

and while maintaining the beam in a fixed position on the axis of the pipe length;

mounting on the beam a rotating hub at a first open end of the pipe length to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said first end in said grinding plane;

mounting on the beam a rotating hub at the second open end of the pipe length to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said second end in said grinding plane;

such that the first and second ends lie in planes accurately radial to the axis of the pipe length;

the two pipe portions being aligned and each having a peripheral wall with an inner surface surrounding an axis and respective adjacent open ends each defining an outer edge for squaring, the open ends facing each other with said space therebetween and the pipe portions having the axes thereof at least substantially aligned;

inserting into the pipe portions an elongate, straight, central mounting beam so as to extend partly into each pipe portion and to bridge the space;

providing a first and a second support spider each arranged adjacent a respective end of the beam and within a respective end of the pipe portions and each having a center hub at the beam and a plurality of legs extending radially outwardly from the hub to the inner surface for supporting the beam a the axis of the pipe portion, the legs being angularly spaced around the axis, the legs each having an adjustment portion for adjusting a length of the leg from the hub to the inner surface;

adjusting the legs at each end while measuring the position of the beam relative to the inner surface of the respective pipe portion to locate the hub and the adjacent portion of the beam at the axis of the respective pipe portion;

and while maintaining the beam in a fixed position on the axes of the pipe portions;

mounting on the beam a rotating hub at the open end of the first pipe portion to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said end of the first pipe portion in said grinding plane;

mounting on the beam a rotating hub at the open end of the second pipe to rotate about the axis;

mounting on the rotating hub an arm extending outwardly at a right angle to the beam;

mounting a grinding tool on the arm at a right angle to the arm so as to define a grinding plane accurately at right angles to the axis;

and rotating the arm around the axis to effect grinding of said end of the second pipe portion in said grinding plane;

such that the ends of the first and second pipe portions lie in planes accurately radial to the axis;

inserting the pipe length into the space between the pipe portions;

and welding the ends of the pipe length to the ends of the pipe portions.

* * * * *